US008511768B2

(12) United States Patent
Brachert

(10) Patent No.: US 8,511,768 B2
(45) Date of Patent: Aug. 20, 2013

(54) HOUSING FOR A HOUSEHOLD APPLIANCE

(75) Inventor: Rainer Brachert, Gundelfingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1465 days.

(21) Appl. No.: 10/582,209

(22) PCT Filed: Dec. 6, 2004

(86) PCT No.: PCT/EP2004/053296

§ 371 (c)(1),
(2), (4) Date: Jun. 9, 2006

(87) PCT Pub. No.: WO2005/056959

PCT Pub. Date: Jun. 23, 2005

(65) Prior Publication Data

US 2007/0113377 A1 May 24, 2007

(30) Foreign Application Priority Data

Dec. 15, 2003 (DE) ..... 103 58 731

(51) Int. Cl.
*A47B 96/04* (2006.01)

(52) U.S. Cl.
USPC ..... 312/405; 312/329; 312/138.1; 16/238; 16/247

(58) Field of Classification Search
USPC ..... 312/138.1, 116, 109, 405, 326, 329; 16/238, 240, 246–247; 49/396
See application file for complete search history.

(56) References Cited

U.S. PATENT DOCUMENTS

| | | | | |
|---|---|---|---|---|
| 2,154,716 | A | 4/1939 | Anderson | |
| 3,555,733 | A * | 1/1971 | Horgan, Jr. | 49/388 |
| 4,815,162 | A | 3/1989 | McAteer | |
| 4,932,729 | A * | 6/1990 | Thompson et al. | 312/405 |
| 5,113,628 | A * | 5/1992 | Richardson et al. | 52/171.3 |
| 5,158,503 | A * | 10/1992 | Mitchell | 16/278 |
| 5,353,476 | A | 10/1994 | Domenig | |
| 5,471,709 | A * | 12/1995 | Lanzani | 16/238 |
| 5,579,606 | A * | 12/1996 | Kim | 49/386 |
| 5,788,351 | A * | 8/1998 | Prunty et al. | 312/326 |
| 8,307,502 | B2 * | 11/2012 | Bonomie et al. | 16/249 |

FOREIGN PATENT DOCUMENTS

GB 708367 5/1954

OTHER PUBLICATIONS

International Search Report PCT/EP2004/053296.

* cited by examiner

*Primary Examiner* — Darnell Jayne
*Assistant Examiner* — Daniel Rohrhoff
(74) *Attorney, Agent, or Firm* — James E. Howard; Andre Pallapies

(57) ABSTRACT

A housing for a cabinet-like household appliance has a body and at least one door, which is connected to the body in a manner that enables it to swivel due to the provision of at least one first and one second multiple-articulation hinge. The door is supported on an upper supporting surface of the first multiple-articulation hinge and on a lower supporting surface of the second multiple-articulation hinge by means of at least one shim inserted between the door and at least one of the supporting surfaces.

27 Claims, 2 Drawing Sheets

HOUSING FOR A HOUSEHOLD APPLIANCE

The present invention relates to a housing for a cabinet-like household appliance, especially a refrigerating device such as a refrigerator, a bottle storage cabinet or the like.

In built-in refrigeration devices the door fitted to the appliance at the manufacturers is usually concealed in the built-in appliance behind a furniture panel which swivels when opening and closing the door. In order to deliver an aesthetically satisfactory appearance, the edges of this furniture panel must be aligned exactly to those of adjacent cabinet doors. For this purpose the furniture panel itself can be attached as a door to a furniture body receiving the refrigeration device, and the furniture panel and the door of the refrigeration device are displaceably coupled to one another so that the door of the refrigeration device can follow a swivelling movement of the furniture flap although the swivel axes of furniture panel and refrigeration device door are not the same. The furniture panel must be aligned to neighbouring cabinet doors using hinges which connect the furniture panel to the furniture body; precise adjustability of the refrigeration device door is not necessary.

The situation is different in built-in household appliances comprising a body and a door where the door supplied by the appliance manufacturer is provided to remain visible and uncovered in the built-in position of the refrigeration device. In this case, the door of the appliance needs to be adjustable in relation to the body. In exactly the same way in household appliances having a plurality of adjacent doors, at least one door must be adjustable to align its edges so that they are flush with those of another.

In order to achieve a desired opening movement of the door of the household appliance, for example, to prevent a side of the door close to the hinge from hitting against an adjacent wall of the furniture compartment, it is frequently necessary to attach the door to the body of the appliance by means of multiple-articulation hinges. When the fixing points of these hinges are not exactly matched to one another on the body and on the door of the appliance, so that the arrangement of body, hinges and door is under internal stress, it can arise that the axes of the hinges are deflected from an exactly parallel orientation and thus execute a precessional movement during opening and closing of the door. The lifetime of the hinges is thereby considerably shortened.

It is the object of the invention to provide a housing for a cabinet-like household appliance, comprising a body and at least one door, which are connected by means of at least two multiple-articulation hinges which allows the user to align the door position using simple means and without the risk of strain which wears down the hinges.

The object is solved by the door being supported on an upper supporting surface of the first multiple-articulation hinge and a lower supporting surface of the second multiple-articulation hinge by means of at least one shim, preferably a large number of shims inserted between the door and at least one of the supporting surfaces. The number of shims which must be provided to mount the door free from stresses on the housing can be specified by the manufacturer of the housing, depending on the manufacturing tolerance as a standard amount for a housing model or individually for each individual model; a user who wishes to adjust the height of the door at a later time can do this by moving shims from a gap between the door and one of the supporting surfaces into the gap between the door and the respectively other supporting surface. As long as the number of shims used remains the same, the suspension of the door remains stress-free.

A heat-insulating body of the door is preferably arranged between the supporting surfaces of the hinge and in order to conceal the hinges, edge sections projecting over the heat-insulating body are formed on an outer wall of the door facing the user.

The outer wall of the door can in particular be a glass pane. The glass pane is preferably transparent at least in a central area to allow a view into the interior of the housing; in the edge zone said pane is preferably provided with a non-transparent coating which conceals the hinges and optionally, other parts of the door.

The door is preferably held on the supporting surface of at least one of the hinges by one or more screws. Such a screw preferably extends through an oblong hole of the supporting surface to allow an adjusting movement of the door and the screw in the direction of the oblong hole. Thus, in addition to the degree of freedom of adjustment in the vertical direction provided by the shims, an additional degree of freedom of adjustment is provided for the door which can be oriented in any horizontal direction.

This second degree of freedom of the adjustment is preferably aligned parallel to the door.

In order to facilitate the adjustment in the second degree of freedom, the multiple-articulation hinge is preferably provided with a first lug connected to the supporting surface and the door is provided with a second lug opposite to the first lug which is aligned perpendicular to the alignment of the oblong hole i.e., perpendicular to the orientation of the second degree of freedom of the adjustment and is provided with holes for receiving a screw which are aligned to one another. By tightening the screw held in a thread, the two lugs can be tightened precisely adjustably to one another which allows fast, tailor-made adjustment.

The thread receiving the screw can belong to a nut where the two lugs lie between the nut and the head of the screw; however, the thread is preferably formed by the hole in one of the lugs.

The hole in the other lug can be a vertically aligned oblong hole.

The second lug can be a fixed component of the door; in this case, the vertically aligned oblong hole would be required to receive height fluctuations of the door in relation to the first lug resulting from the displacement of shims. However, the second lug preferably comprises a part of a component which can be detachably screwed onto the door. The shims are then appropriately dimensioned so that when mounted, they not only extend between the supporting surface of the multiple-articulation hinge and the door but also between the component bearing the second lug and the door so that the height of this component does not vary in relation to the multiple-articulation hinge even when the height of the door is varied by moving the shims.

Further features and advantages of the invention are obtained from the following description of exemplary embodiments with reference to the appended figures. In the figures:

FIG. 1 shows a perspective view of a bottle storage cabinet as an example of a household appliance to which the present invention is applied.

Figure 1:
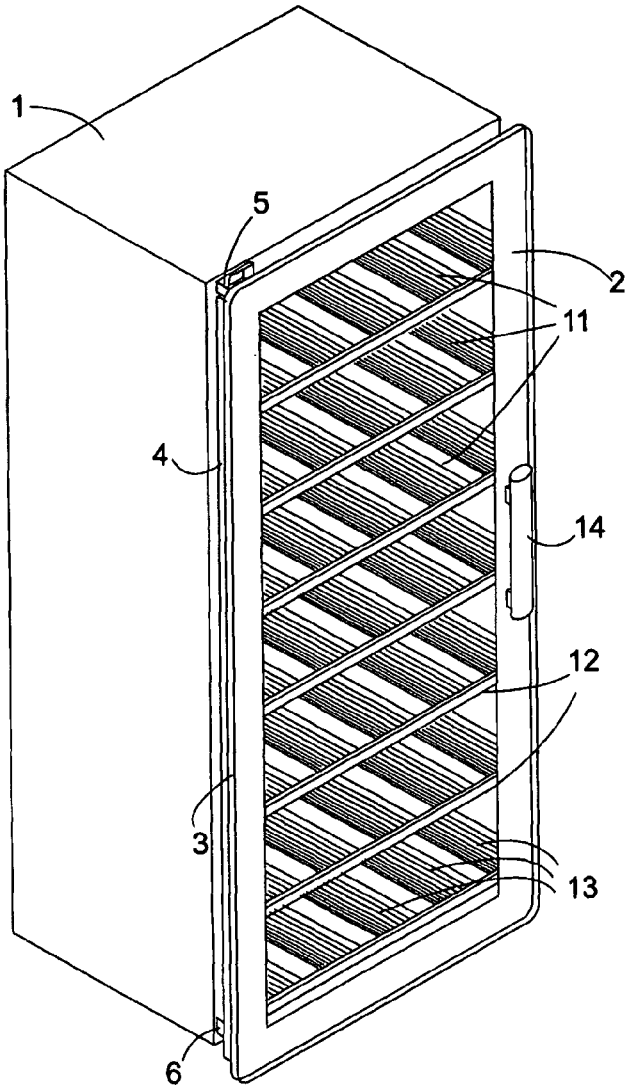
FIG. 1 is a perspective view of a wine storage cabinet as an example of a household appliance having a housing according to the invention.

The body 1 of the bottle storage cabinet is provided for building into a furniture cavity (not shown). However, whereas in most built-in refrigeration devices in the built-in state, the front of the door is covered by a furniture panel, the door 2 of the appliance shown here is provided to remain freely visible in the built-in state.

An outer wall of the door 2 is formed by a glass panel 3 which is stuck to a rectangular metal frame 4 at its back. A movable element of a multiple-articulation hinge 5, 6 acts on an upper side and a lower side of the frame. An inner glass panel 7 (see FIG. 2) is connected to the outer glass panel 3 by means of a second rectangular frame 8 which is surrounded by the frame 4 without touching it. An intermediate space 9 sealed in an airtight manner, defined by the two glass panels 3, 7 and the frame 8, is filled with a heat-insulating gas.

In its edge zone at the back, the glass panel 3 is provided with an opaque coating 10 which conceals the frames 4, 8 from the view of an observer standing in front of the bottle storage cabinet. In a central area of the door, both glass panels 3, 7 are transparent and allow the interior of the body 1 to be viewed. Located therein are a plurality of bottle racks 11, each formed by front and rear horizontal supports 12 and cylinder-segment-shaped shells 13 suspended between the supports.

A handle 14 attached to the outer glass panel 3 is screwed into the outer frame 4 through two holes in the glass panel 3.

The four sides of the outer frame 4 are each composed of an outer profile 15, an inner profile 16 and a magnetic sealing strip 17 anchored between the two profiles 15, 16 by a tongue and groove joint, which seals the closed door 2 at the front of the body 1. The inner profile 16 directly adjacent to the interior of the refrigeration device and the outer profile 15 in contact with the ambient air are insulated from one another by the magnetic sealing strips 17 and its inner cavities. Clamped between the inner profile 16 and the inner glass panel 7 is a flexible sealing strip 18 which prevents cold air from the interior of the appliance from penetrating between the frames 4, 8 as far as the outer glass panel 3.

Figure 2:
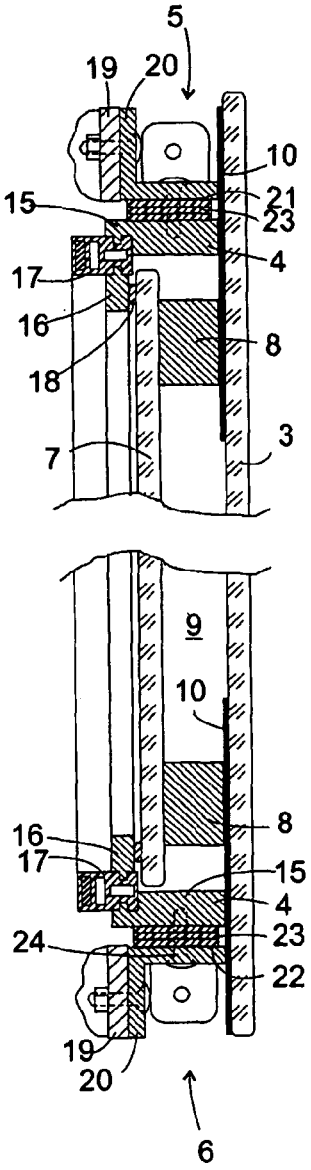
FIG. 2 is a vertical section through the door of the wine storage cabinet.

Of the multiple-articulation hinges 5,6 known per se and therefore not described in further detail here, FIG. 2 shows only one movable hinge element 19 to which an L-shaped support element 20 in the cross-section in FIG. 2 is screwed. The support element 20 of the lower multiple-articulation hinge has an upper supporting surface 22 on which a lower side of the frame 4 rests, separated by a plurality of rectangular shims 23. The horizontal leg of the lower support element 20 forming the supporting surface 22 is connected to the frame 4 by one or more screws 24 which extend through holes in the leg and the shims 23 of the plastic injection moulding and engage in an inner thread of the outer profile 15.

In mirror symmetry hereto, the support element 20 of the upper multiple-articulation hinge 5 has a lower supporting surface 21 facing the frame 4 and a gap between this supporting surface 21 and the frame 4 is filled by shims 23 free from play. The upper support element 20 is screwed to the frame 4.

Figure 3:
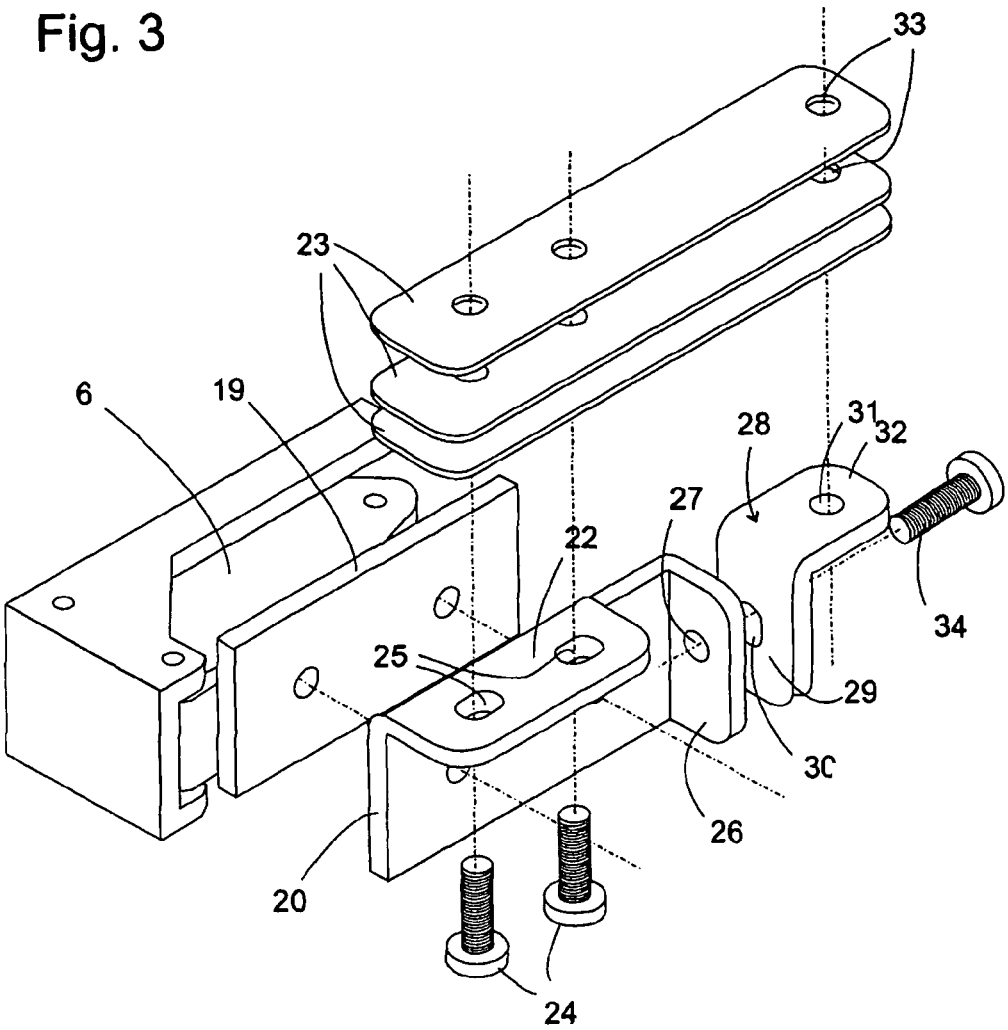
FIG. 3 is an exploded view of a multiple-articulation hinge and other components which interconnect the door and the body of the wine storage cabinet.

FIG. 3 is an exploded view showing the lower multiple-articulation hinge 6 comprising its movable hinge element 19, the support element 20 screwed thereto and three shims 23 for filling a gap between the supporting surface 22 and the frame 4 which is not shown in this figure. It can be seen that the holes 25 in the horizontal leg of the support element 20 are oblong holes which are aligned parallel to the level of the door 2. A lug 26 is bent at right angles at one longitudinal end of the vertical leg of the support element 20. A tapped hole 27 passes through the lug 26.

An angle element 28 has a vertical leg 29 which lies parallel and opposite to the lug 26 and wherein a vertically aligned oblong hole 30 in alignment with the tapped hole 27 is formed. Another hole 31 is formed in a horizontal leg 32 of the angle element 28 facing the frame 4. The angle element 28 is provided so that the shims 23 can be screwed to the frame 4 using a screw (not shown) through the hole 31 and holes 33 in alignment therewith.

The following procedure can be adopted to adjust the door 2: firstly the amount by which the height of the door 2 is to be corrected is measured on the bottle storage cabinet completely mounted in the furniture cavity provided for it. The door is dismounted by loosening the screws 24 joining the horizontal legs of the support elements 20 to the frame 4. According to the desired change in height, the number of shims 23 on the lower supporting element 20 is reduced or increased by shims which were mounted previously between the frame and the upper supporting element 20. The door 2 is then inserted again, all the remaining spacers 23 being inserted between the frame 4 and the upper support element 20. However, the screws 24 between the support elements and the frame are not yet tightened so that the door can still be displaced parallel to its front side to the extent specified by the extension of the oblong holes (25).

The door is now first pulled to the right relative to the perspective in FIG. 3 so that the screws 24 each push against the right edge of the oblong holes (25). Then, respectively one screw 34 is screwed into the tapped holes 27 of the two support elements 20 through the oblong holes 30 of the two angle elements 28. The head of the screw 34 then finally pushes against the vertical leg 29 so that when the screw 34 is turned further over the angle element 28, the door is shifted to the right. Then, following the height adjustment the position of the door is continuously adjusted in the lateral direction and with high accuracy.

Figure 4:
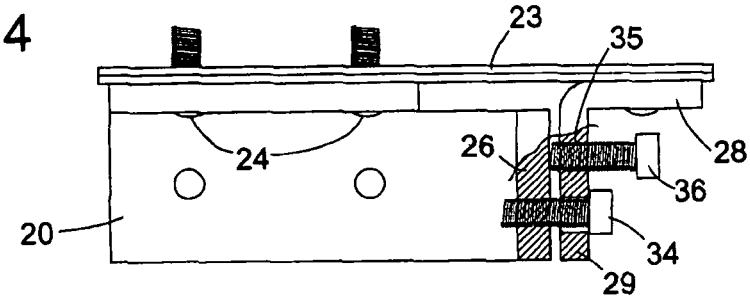
FIG. 4 is a partial cutaway view of the components from FIG. 3 according to a modified embodiment.

FIG. 4 shows the support element 20, the angle element 28 and shims 23 resting thereon according to a modified embodiment. In this embodiment, a tapped hole 35 into which a screw 36 engages, is formed in addition to the oblong hole 30 in the vertical leg 29 of the angle element 28. This tapped hole 35 is not opposite to any opening in the lug 26. The screw 36 which thus presses with its tip against the lug 26 can be used to shift the door precisely and continuously to the right during the adjustment or to counter the screw 34 and thus fix the door in an adjusted horizontal position.

The invention claimed is:

1. A housing for a household appliance, comprising:

a body;

a first multiple-articulation hinge having a hinge arm;

a second multiple-articulation hinge having a hinge arm;

a door connected to the body by the first multiple-articulation hinge and the second multiple-articulation hinge in a manner that enables the door to swivel with respect to the body;

a mounting bracket coupled between each of the hinge arm of the first multiple-articulation hinge and the door and the hinge arm of the second multiple-articulation hinge and the door, the mounting bracket permitting the door to be adjusted in a horizontal direction with respect to the body, wherein the mounting bracket comprises a support element connected to the hinge arm, the support element including a supporting surface and a lug, the door being supported on the supporting surface, and wherein the door includes an angled element having a vertical leg disposed adjacent the lug and a horizontal leg being disposed substantially co-planar with the supporting surface, the angled element being movable in the horizontal direction with respect to the support element and permitting the door to be adjusted in the horizontal direction with respect to the body, and at least one shim removably inserted between the door and the supporting surface and between the door and the horizontal leg and permitting the door to be adjusted in a vertical direction with respect to the body.

2. The housing according to claim 1, wherein a plurality of shims is inserted between the supporting surface and the door.

3. The housing according to claim 1, wherein the shims have a rectangular basic outline and are made of a plastic injection molding.

4. The housing according to claim 1, wherein a heat-insulating body of the door is arranged between the supporting surface and each of the first and second multiple-articulation hinges and the first and second multiple-articulation hinges are concealed behind edge sections of the door projecting over the body.

5. The housing according to claim 1, wherein an outer wall of the door is formed by a glass pane.

6. The housing according to claim 1, wherein the supporting surface is connected to the door by means of at least one screw on at least one of the multiple-articulation hinges.

7. The housing according to claim 6, wherein the screw extends through an oblong hole of the supporting surface.

8. The housing according to claim 7, wherein the oblong hole is aligned parallel to the door.

9. The housing according to claim 8, wherein the multiple-articulation hinge has a first lug connected to the supporting surface and the door has a second lug opposite to the first lug which is aligned perpendicular to the alignment of the oblong hole and is provided with holes for receiving a screw which are aligned to one another.

10. The housing according to claim 9, wherein one of the holes is a tapped hole.

11. The housing according to claim 9, wherein another hole of the holes is a vertically aligned oblong hole.

12. The housing according to claim 9, wherein the second lug is a part of a component screwed onto the door.

13. The housing according to claim 12, wherein the shims are dimensioned so as to extend as far as between the component and the door when mounted between the supporting surface of one multiple-articulation hinge and the door.

14. The housing according to claim 1, wherein the at least one shim inserted between the door and the at least one of the supporting surfaces causes the door to be adjusted in a vertical direction with respect to the body.

15. A housing for a household appliance, comprising a body and at least one door, which is connected to the body in a manner that enables it to swivel due to the provision of at least one first and one second multiple-articulation hinge, wherein the door is supported on an upper supporting surface of the first multiple-articulation hinge and a lower supporting surface of the second multiple-articulation hinge by means of at least one shim inserted between the door and at least one of the supporting surfaces, wherein the supporting surface is connected to the door by means of at least one screw on at least one of the multiple-articulation hinges, wherein the screw extends through an oblong hole of the supporting surface, wherein the oblong hole is aligned parallel to the door, and wherein the multiple-articulation hinge has a first lug connected to the supporting surface and the door has a second lug opposite to the first lug which is aligned perpendicular to the alignment of the oblong hole and is provided with holes for receiving a screw which are aligned to one another.

16. The housing according to claim 15, wherein one of the holes is a tapped hole.

17. The housing according to claim 15, wherein another hole of the holes is a vertically aligned oblong hole.

18. The housing according to claim 15, wherein the second lug is a part of a component screwed onto the door.

19. The housing according to claim 18, wherein the shims are dimensioned so as to extend as far as between the component and the door when mounted between the supporting surface of one multiple-articulation hinge and the door.

20. A refrigerator comprising:

a housing including a body and a door;

first and second multiple-articulation hinges coupling the door to the body in a manner that enables the door to swivel, wherein the door is supported with an upper supporting surface of the first multiple-articulation hinge and a lower supporting surface of the second multiple-articulation hinge;

at least one shim removably inserted between the door and one of the supporting surfaces permitting the door to be adjusted in a vertical direction with respect to the body;

a mounting bracket coupled between the first multiple-articulation hinge and the door and permitting the door to be adjusted in a horizontal direction with respect to the body, wherein the mounting bracket comprises:

a support element connected to the first multiple-articulation hinge and including a support surface and a lug having a first tapped hole;

an angled element having a vertical leg disposed adjacent the lug and a horizontal leg being disposed substantially co-planar with the support surface;

a first set screw extending through the vertical leg and threadedly engaging the first tapped hole, the position of the door with respect to the body being continuously adjustable in the horizontal direction in response to rotation of the first set screw.

21. The refrigerator according to claim 20, wherein the vertical leg of the angled element includes a second tapped hole, a second set screw threadedly engaging the second tapped hole and extending beyond the angled element to contact a surface of the lug, the position of the door with respect to the body being continuously adjustable in the horizontal direction in response to rotation of the second set screw.

22. The refrigerator according to claim 20, further comprising a plurality of shims removably inserted between the supporting surfaces and the door, the position of the door with respect to the body being adjustable in the vertical direction in response to the number of shims disposed between the supporting surfaces and the door.

23. A housing for a household appliance, comprising:

a body;

at least one door coupled to the body in a manner that enables the at least one door to swivel with respect to the body, the at least one door being vertically adjustable with respect to the body;

at least one first multiple-articulation hinge, wherein a lower end of the door is supported on an upper supporting surface of the first multiple-articulation hinge;

at least one second multiple-articulation hinge, wherein an upper end of the door is supported by a lower supporting surface of the second multiple-articulation hinge; and at least one shim between the lower end of the door and the upper supporting surface of the first multiple-articulation hinge, and the upper end of the door and the lower supporting surface of the second multiple-articulation hinge, the at least one shim vertically adjusting a position of the door with respect to the body, wherein each of the upper supporting surface and the lower supporting surface includes a first lug having a first screw hole, and wherein the door includes a first angled element and a second angled element respectively adjacent to each of the upper supporting surface and the lower supporting surface, each of the first angled element and the second angled element having a second lug disposed adjacent to the first lug and a horizontal leg disposed substantially co-planar with the respective upper supporting surface and lower supporting surface, the second lug having a second screw hole, the first lug being secured to the second lug with a screw inserted through the first screw hole and the second screw hole such that the first lug is movable in a horizontal direction with respect to the second lug and permitting the door to be adjusted in the horizontal direction with respect to the body.

24. The housing according to claim 23, wherein the at least one shim includes a plurality of shims, wherein at least one first shim of the plurality of shims is between the lower end of the door and the upper supporting surface of the first multiple-articulation hinge, and wherein at least one second shim of the plurality of shims is between the upper end of the door and the lower supporting surface of the second multiple-articulation hinge.

25. The housing according to claim 24, wherein the plurality of shims includes a predetermined total number of shims between the lower end of the door and the upper supporting surface of the first multiple-articulation hinge, and the upper end of the door and the lower supporting surface of the second multiple-articulation hinge.

26. The housing according to claim 25, wherein a number of the at least one first shim of the plurality of shims is different than a number of the at least one second shim of the plurality of shims.

27. The housing according to claim 23, wherein each of the upper supporting surface and the lower supporting surface includes an oblong hole aligned parallel to the door, and wherein the supporting surface is connected to the door by at least one screw extending through the oblong hole and permitting the door to be adjusted in the horizontal direction with respect to the body.

* * * * *

UNITED STATES PATENT AND TRADEMARK OFFICE

CERTIFICATE OF CORRECTION

PATENT NO. : 8,511,768 B2
APPLICATION NO. : 10/582209
DATED : August 20, 2013
INVENTOR(S) : Rainer Brachert It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1140 days.

Signed and Sealed this
Fifteenth Day of September, 2015

Michelle K. Lee

Michelle K. Lee
*Director of the United States Patent and Trademark Office*